United States Patent [19]

Cook

[11] Patent Number: 5,020,414

[45] Date of Patent: Jun. 4, 1991

[54] PORTABLE AMMUNITION COUNTER

[75] Inventor: Mark A. Cook, Orlando, Fla.

[73] Assignee: The United States of America as represented by the Secretary of the Air Force, Washington, D.C.

[21] Appl. No.: 506,416

[22] Filed: Apr. 6, 1990

[51] Int. Cl.[5] ..... F41A 9/79

[52] U.S. Cl. ..... 89/33.16; 89/34

[58] Field of Search ..... 89/34, 33.16, 33.25, 89/33.17; 198/831

[56] References Cited

U.S. PATENT DOCUMENTS

| | | | |
|---|---|---|---|
| 2,110,160 | 3/1938 | Lavsson | 89/34 |
| 2,386,894 | 10/1945 | Hartley | 89/34 |
| 4,001,961 | 1/1977 | Johnson et al. | 324/94 |
| 4,506,588 | 3/1985 | Kazanjy | 89/34 |
| 4,510,844 | 4/1985 | Fritz et al. | 89/135 |
| 4,881,447 | 11/1989 | Yanusko et al. | 89/34 |

FOREIGN PATENT DOCUMENTS

| | | | |
|---|---|---|---|
| 2430002 | 1/1976 | Fed. Rep. of Germany | 89/33.25 |

*Primary Examiner*—Charles T. Jordan
*Assistant Examiner*—Stephen Johnson
*Attorney, Agent, or Firm*—Bobby D. Scearce; Donald J. Singer

[57] ABSTRACT

A portable counter for belted ammunition contained in linked tubes of a flexible ammunition carrier is described which comprises a pair of upright wall members and a top plate holding the wall members in preselected spaced relationship to each other and defining an entrance side and an exit side for the counter, a rotatable paddle wheel disposed between the wall members and defining a passageway between the paddle wheel and top plate from the entrance side to the exit side of the counter, the paddle wheel including a plurality of paddles sized and spaced to engage spaces between adjacent tubes of the ammunition carrier to carry the ammunition carrier through the passageway, and a mechanical counter operatively contacting the tubes of the flexible ammunition carrier for counting the tubes as they are carried through the counter with rotation of the paddle wheel.

5 Claims, 2 Drawing Sheets

PORTABLE AMMUNITION COUNTER

RIGHTS OF THE GOVERNMENT

The invention described herein may be manufactured and used by or for the Government of the United States for all governmental purposes without the payment of any royalty.

BACKGROUND OF THE INvENTION

The present invention relates generally to devices for counting rounds of ammunition in a linked tube carrier, and more particularly to a portable, manually operated ammunition counter which is characterized by ease of operation and which may be operated remote from conventional sources of power.

Critical weapon staging area functions include maintenance of accurate counts of ammunition stored and ready for loading into weapon systems and downloaded from weapon systems and returned to storage. Counting rounds carried in flexible ammunition belts can be particularly difficult and time consuming because of the weight and unwieldiness of the belts. Presently used systems for counting belted ammunition are generally electrically powered and require several persons to operate.

The invention eliminates or substantially reduces in critical importance problems with conventional systems by providing a portable, manually operated ammunition counter for accurately counting belted rounds of ammunition. The invention is light in weight and requires no external source of power. The counter is attachable directly to standard ammunition cans and carries an ammunition belt over a feed paddle wheel past a mechanical counter by the action of a manually operated crank handle.

It is therefore a principal object of the invention to provide a portable counter for rounds of belted ammunition.

It is a further object of the invention to provide a manually operated ammunition counter requiring no external source of power.

These and other objects of the invention will become apparent as a detailed description of representative embodiments proceeds.

SUMMARY OF THE INvENTION

In accordance with the foregoing principles and objects of the invention, a portable counter for belted ammunition contained in linked tubes of a flexible ammunition carrier is described which comprises a pair of upright wall members and a top plate holding the wall members in preselected spaced relationship to each other and defining an entrance side and an exit side for the counter, a rotatable paddle wheel disposed between the wall members and defining a passageway between the paddle wheel and top plate from the entrance side to the exit side of the counter, the paddle wheel including a plurality of paddles sized and spaced to engage spaces between adjacent tubes of the ammunition carrier to carry the ammunition carrier through the passageway, and a mechanical counter operatively contacting the tubes of the flexible ammunition carrier for counting the tubes as they are carried through the counter with rotation of the paddle wheel.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
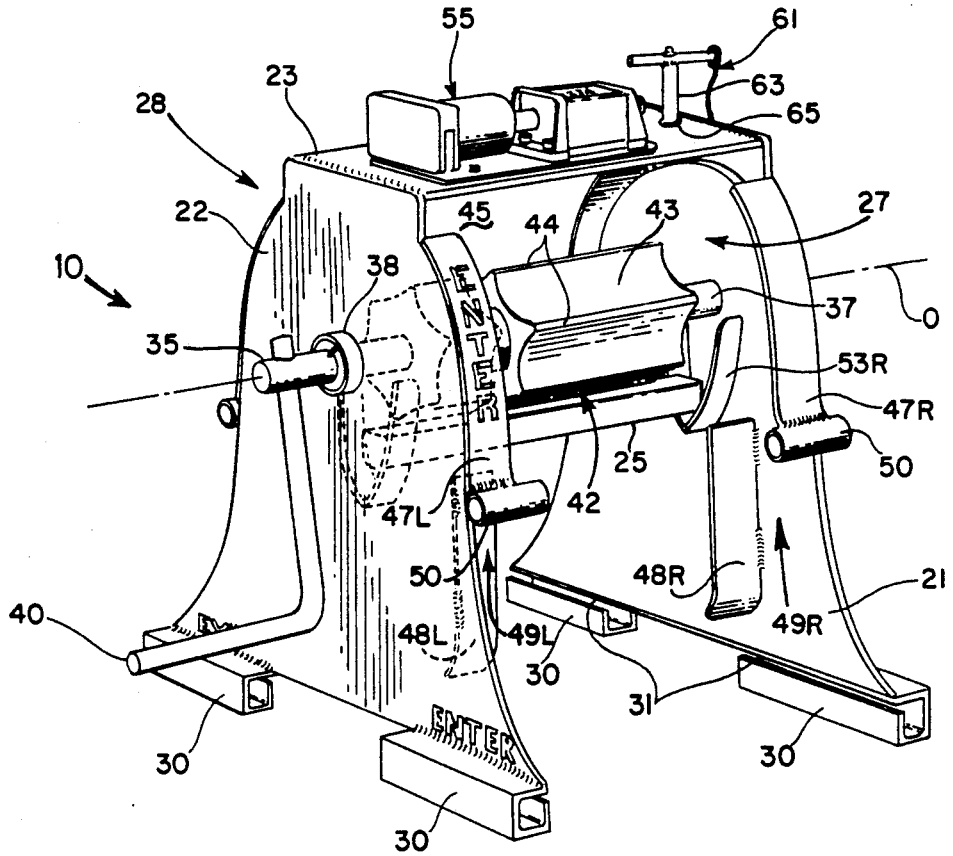
FIG. 1 is a perspective view of the portable ammunition counter of the invention.
Figure 2:
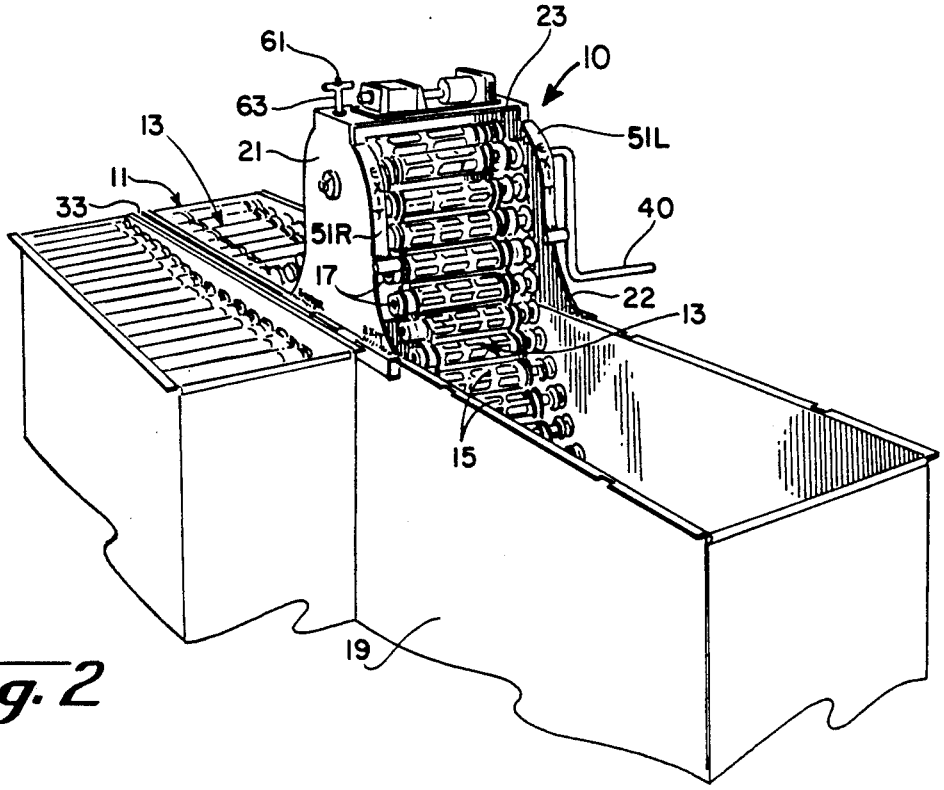
FIG. 2 shows the counter of FIG. 1 in place on an ammunition shipping can.

Referring now to the drawings, FIG. 1 shows a perspective view of the portable ammunition counter 10 of the invention. FIG. 2 shows counter 10 in place on an ammunition shipping can 11. In accordance with a principal object of the invention, counter 10 is configured for counting ammunition contained in ammunition belts, such as the linked tube carrier 13 shown in FIG. 2. It is noted that counter 10 in alternate embodiments may be used to count empty tubes or spent shell casings in carrier 13. Carrier 13 is a conventional configuration in which large caliber ammunition (e.g. 30 mm) is received from a supplier, and comprises a plurality of linked tubes 15 each sized to carry a round 17 of ammunition of corresponding size. A substantially continuous carrier 13 of considerable, often indeterminant length is transported in can 11 in layers as suggested in FIG. 2. The counting process contemplated herein using counter 10 is performed by feeding carrier 13 from can 11 through counter 10 and into a second shipping/storage can 19 as suggested in FIG. 2.

In order to perform the counting process, counter 10 may comprise two upright wall members 21,22 held in preselected spaced relationship to each other by top plate 23 and a floating spacer bar 25. Entrance side 27 and exit side 28 are thereby defined for feeding carrier 13 through counter 10 as described more fully below. The spacing between wall members 21, 22 corresponds in size with the size of carrier 13 and the width of can 11. Wall members 21,22 are supported by suitable means for attachment to can 11. The attachment means may take any suitable form for clamping counter 10 to can 11 or otherwise holding counter 10 stationary relative to can 11. In the FIG. 1,2 embodiment, the attachment means includes four segments 30 of tube stock attached to wall members 21,22 (best seen in FIG. 1), each segment 30 having a slot 31 therein for receiving lip 33 on each side of can 11. Wall members 21,22, plate 23, spacer bar 25, segments 30 and other elements of counter 10 may be constructed of any material having suitable structural strength, such as steel or aluminum, a unit built in demonstration of the invention being constructed of aluminum providing a desirable combination of strength, durability and light weight. Assembly may be by welding.

Axle 35 is horizontally disposed between wall members 21,22 and journaled for rotation about axis 0 at bearing mounts 37,38 in wall members 21,22. Axle 35 extends through wall member 21 and has attached thereto crank handle 40. Feed paddle wheel 42 is disposed on axle 35 for rotation therewith about axis 0, and includes a suitable plurality (six in the FIG. 1 embodiment) of axially extending concavities 43 spaced therearound. Feed paddle 42 defines a passageway 45 through which carrier 13 is passed in performance of the counting function. Each concavity 43 is sized and shaped for receiving successive tubes 15 in carrier 13 as rounds 17 contained therewithin are counted. Ridges 44 extending axially of feed paddle 42 and between which each concavity 43 is defined each have thickness and height appropriate to engage carrier 13 between successive adjacent tubes 15 to pull carrier 13 through counter 10 as feed paddle 42 is rotated. Guide plates 47L,R and 48L,R are welded to respective wall members 21,22 on either side of entrance side 27 in order to define slots 49L,R for guiding respective ends of tubes 15 as carrier 13 is carried through counter 10 by rotation of feed paddle 42. Corresponding guide plates 51L,R may be welded to wall members 21,22 on either side of exit side 28 to guide carrier 13 downwardly from counter 10 and into can 19. Short segments 50 of pipe (about 1" dia×2" long) may be welded to the lower ends of guide plates 47L,R and 51L,R to assist passage of carrier 13 through counter 10. V-shaped guides 53L,R may also be welded to corresponding wall members 21,22 substantially as shown in FIG. 1 to assist in feeding carrier 13 up into and through counter 10.

Rounds counter 55 may be disposed at any suitable position near feed paddle 42 so as to operatively contact tubes 15 of carrier 13. It may be preferable to dispose rounds counter 55 atop top plate 23 as suggested in FIG. 1. Substantially any suitable commercially available mechanical counter (e.g., counter P/N 1444194-3 supplied by Allied Devices Corp, Baldwin N.Y.) may be selected for use. Counter 55 makes contact with each tube 15 as carrier 13 is passed through counter 10. Opening 57 (best seen in the view of FIG. 4) is provided in top plate 23 in order to accommodate the trip mechanism 59 of counter 55 which contacts tubes 15 in the counting process. Trip mechanism 59 is preferably operatively connected to counter 55 such that reversal of direction of travel of carrier 13 on feed paddle 42 (i.e. toward can 11) reverses counter 55.

Stop brake 61 in the form of pin 63 insertable into hole 65 in top plate 23 may be included to secure carrier 13 at any position during the counting process. It may be desirable during the counting process to interrupt tube 15 counting to orderly arrange carrier 13 in can 19 or to perform other tasks while carrier 13 is held firmly in counter 10. Accordingly, during such interruption, pin 63 may be insertable between adjacent tubes 15 on feed paddle 42 to temporarily prevent carrier 13 from passing forwardly or backwardly through counter 10 and to prevent crank handle 40 from swinging uncontrollably.

Figure 4:
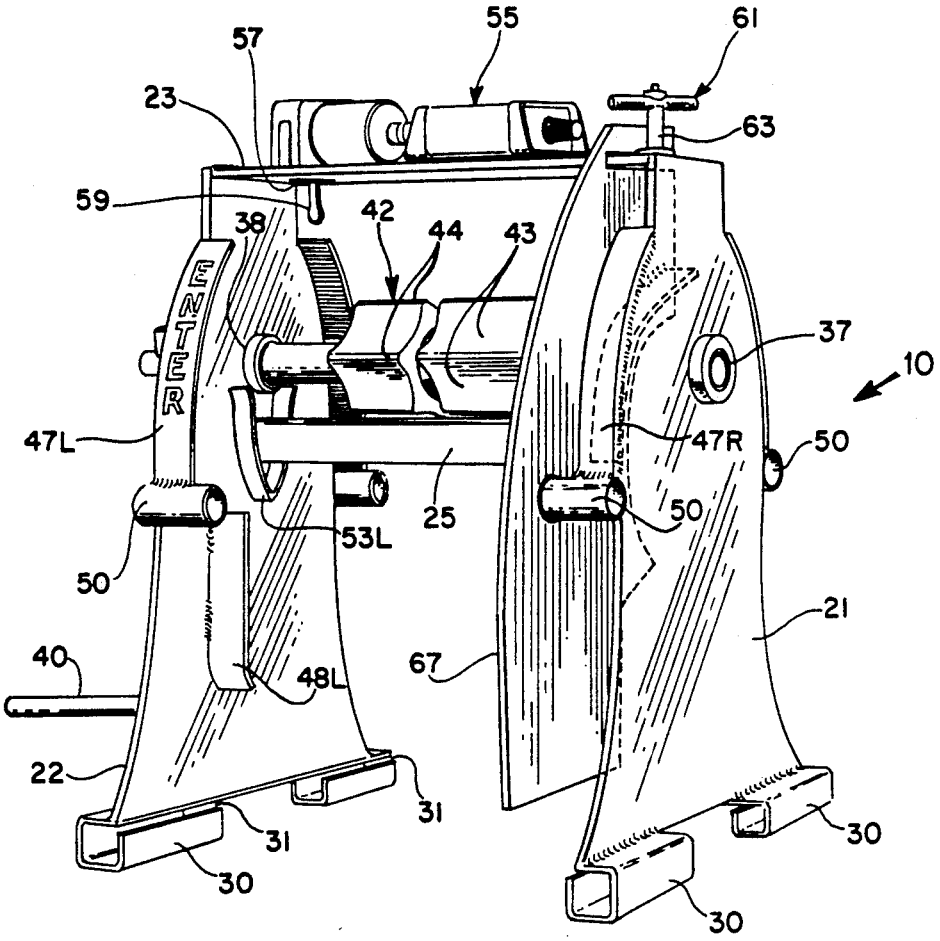
FIG. 4 shows a perspective view of the FIG. 1 counter with a spacer plate in place for counting empty linked tube carriers.
Figure 3:
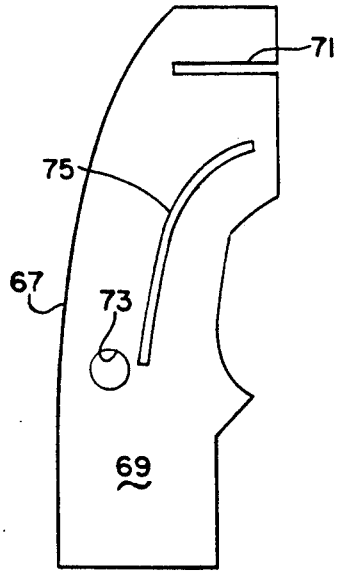
FIG. 3 is a side view of a spacer plate insertable into the FIG. 1 counter for the purpose of counting tubes of an ammunition carrier empty of rounds.

Referring now specifically to FIGS. 3 and 4, shown in FIG. 3 is a perspective view of spacer plate 67 which may be inserted into counter 10 of FIG. 1 in order to count empty tubes 15 in a carrier 13. FIG. 4 shows counter 10 with spacer plate 67 installed therein. In the process of counting tubes 15 of an empty carrier 13, a narrower entrance 27 width for counter 10 is required by reason of rounds 17 having previously been removed. Spacer plate 67 consists essentially of a suitably shaped metal plate section 69 having a slot 71 in one end thereof for engaging top plate 23. Hole 73 is provided at the appropriate location to receive a pipe segment 50 on entrance side 27 of counter 10. Guide plate 75 of appropriate shape is welded to plate section 69 to guide tubes 15 of empty carrier 13 through counter 10 and replaces in function guide plate 47R.

In a unit built in demonstration of the invention herein, counter 10 was constructed substantially of aluminum and assembled by welding. The demonstration unit weighed about 25 pounds and was configured specifically for 30 mm shells in the belted configuration. Accordingly, the unit was sized to span an ammunition can 13 inches wide. Overall height of the unit was about 19 inches.

The counting operation either for rounds 17 contained in carrier 13 or for tubes 15 in an empty carrier 13 may proceed as follows. Reference is made here specifically to FIG. 2. Once the lid from can 11 is removed, lips 33 thereof are inspected and straightened if necessary so that counter 10 may be inserted thereon as described above. Counter 10 is then slipped onto can 11 at lips 33 thereof with entrance side 27 facing carrier 13 within can 11 such that carrier 13 may be fed into entrance side 27 with the bullet ends of rounds 17 on the left side thereof. Can 19 into which rounds 17 tubes 15 are to be counted is then placed end-to-end with can 11. If tubes 15 of an empty carrier 15 are being counted, spacer plate 67 is installed in entrance side 27 of counter 10 as described above in relation to FIGS. 3 and 4. Rounds counter 55 is then set to zero. With crank handle 40 held stationary, the first tube 15 of carrier 13 is then lifted into entrance side 27 along slot 49 and placed into the concavity 43 of feed paddle 42 just next to trip mechanism 59 of counter 55. Crank handle 40 may then be turned until tubes 15 pass through exit side 28 downwardly and under guide plates 51L,R and into can 19. Carrier 13 may be fan folded into can 19 as rounds 17 (or tubes 15) are counted. As suggested above, if the counting process needs to be stopped, crank handle 40 may be held at a suitable orientation so that pin 63 may be inserted between two adjacent tubes 15 to hold carrier 13 stationary. Counting may be continued at any time by removing pin 63 and resuming turning of crank handle 40.

It is noted that the counting process using counter 10 may require the cooperative services of two persons, one to turn crank handle 40 and one to arrange carrier 13 inside can 19 as it is passed out of exit side 28. Conventional techniques may require four or more persons for the same task. The invention provides the further advantage over conventional techniques in that electrical power is not required, i.e., the counting process using the invention can be performed at locations remote from sources of power.

The invention therefore provides an improved portable rounds counter characterized by simplicity of operation and utility in applications remote from conventional power sources. It is understood that modifications to the invention may be made as might occur to one skilled in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A portable counter for belted ammunition contained in linked tubes of a flexible ammunition carrier, comprising:

(a) a pair of upright wall members and a top plate holding said upright wall members in preselected spaced relationship to each other, said upright wall members and said top plate defining an entrance side and an exit side for said counter for feeding said flexible ammunition carrier therethrough;

(b) a rotatable paddle wheel disposed between said upright wall members and defining a passageway between said paddle wheel and said top plate from said entrance side to said exit side of said counter, said paddle wheel including a plurality of paddles sized and spaced to engage spaces between adjacent tubes of said flexible ammunition carrier and thereby carry said flexible ammunition carrier through said passageway from said entrance side to said exit side with rotation of said paddle wheel; and (c) mechanical counting means including means for contacting said tubes of said flexible ammunition carrier and counting said tubes as said flexible ammunition carrier is carried through said passageway with the rotation of said paddle wheel.

2. The counter of claim 1 further comprising means for attaching said upright wall members to a container for said flexible ammunition carrier.

3. The counter of claim 1 wherein said rotatable paddle wheel has a crank handle operatively attached thereto for manual rotation of said rotatable paddle wheel.

4. The counter of claim 1 further comprising a pin insertable through a hole defined in said top plate and between adjacent tubes of said flexible ammunition carrier to selectively hold said flexible ammunition carrier at a selected position therealong within said passageway.

5. The counter of claim 1 further comprising a spacer plate insertable between said upright wall members and over said paddle wheel for narrowing said entrance side for counting tubes of said ammunition carrier from which ammunition rounds have been removed.

* * * * *